United States Patent [19]

Sheffield et al.

[11] 4,275,582

[45] Jun. 30, 1981

[54] BREAKSTEM RIVETING TOOL WITH STEM DISPOSAL DEVICE

[76] Inventors: David J. Sheffield, 66 Varney Rd., Hemel Hempstead, Hertfordshire; Martyn R. Fulton, 127 Codicote High St., Codicote, Hitchin, Hertfordshire, both of England

[21] Appl. No.: 84,158

[22] Filed: Oct. 12, 1979

[30] Foreign Application Priority Data

Oct. 20, 1978 [GB] United Kingdom ..... 41415/78

[51] Int. Cl.[3] ..... B21J 15/34

[52] U.S. Cl. ..... 72/391; 72/453.17

[58] Field of Search ..... 72/391, 453.17, 453.16, 72/453.15, 114

[56] References Cited

U.S. PATENT DOCUMENTS

| | | | |
|---|---|---|---|
| 3,363,445 | 1/1968 | Sanders | 72/391 |
| 3,367,166 | 2/1968 | Newton | 72/391 |
| 3,415,102 | 12/1968 | Elliott | 72/391 |
| 3,523,441 | 8/1970 | Bell | 72/391 |
| 3,657,915 | 4/1972 | Lee | 72/391 |

*Primary Examiner*—Nicholas P. Godici
*Assistant Examiner*—Gene P. Crosby
*Attorney, Agent, or Firm*—Oblon, Fisher, Spivak, McClelland & Maier

[57] ABSTRACT

A blind riveting tool head for placing blind breakstem rivets is provided with a stem-disposal device which comprises a flexible hose connected to the rear end of a passage running rearwardly through the head from the rivet-placing jaws. An air injector at the junction of the head and the hose supplies both a flow of air rearwardly along the hose to assist broken-off stem portions rearwardly therealong, and also a flow of air forwardly along the passage through the head.

5 Claims, 2 Drawing Figures

BREAKSTEM RIVETING TOOL WITH STEM DISPOSAL DEVICE

Figure 1:
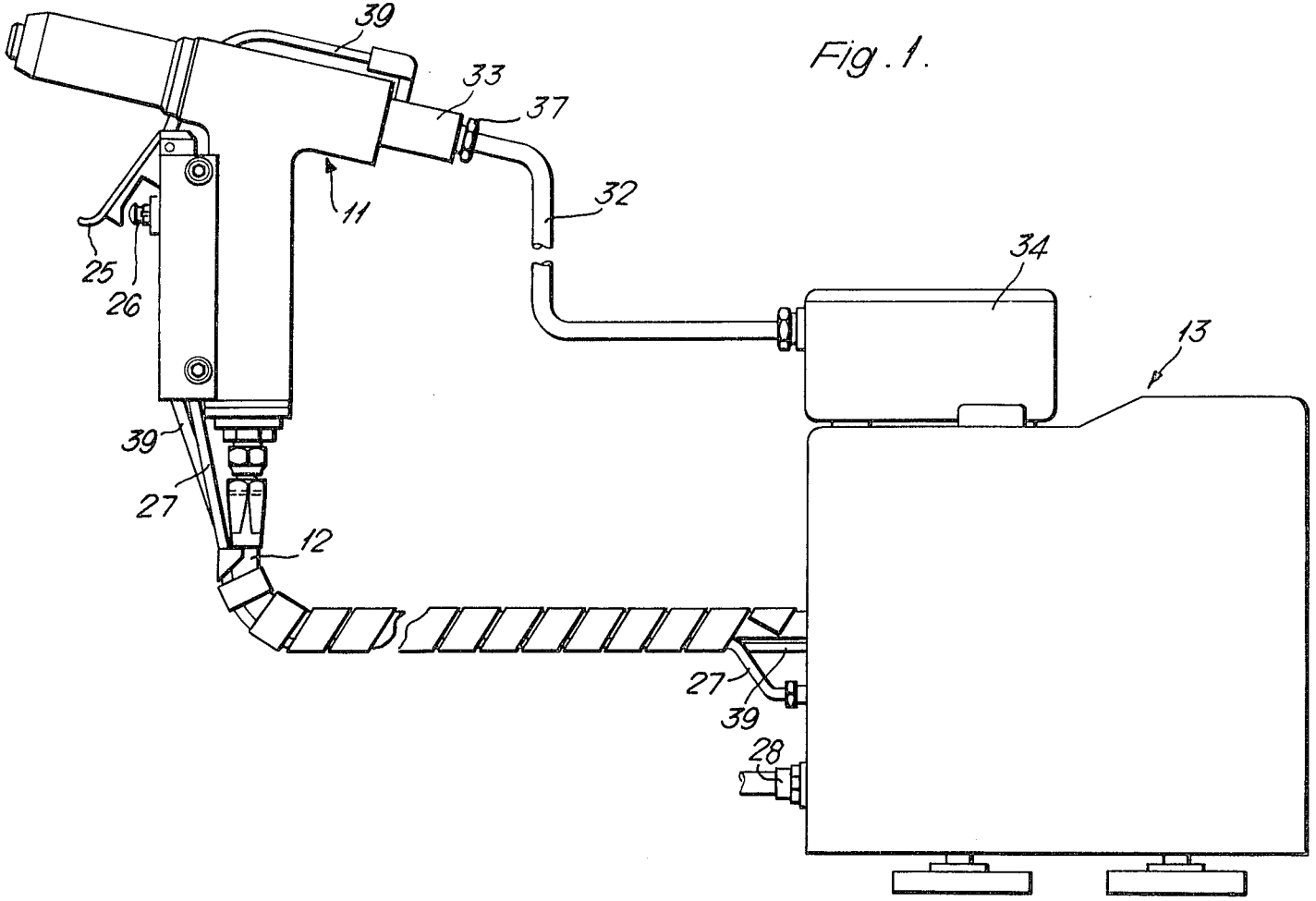

The invention relates to a breakstem riveting tool with a stem disposal device. A breakstem riveting tool operates by first acting on the stem or mandrel of a rivet (e.g. by pulling it or rotating it) thereby to place or install the rivet, and then breaking off a portion of the stem which protrudes from the placed rivet. The broken-off stem portion may then be allowed to drop out of the tool. However, this can easily constitute a hazard, for example by direct impact on the operator of the tool, or by falling on the floor so that the operator or some other person may slip on it (rivet stems are commonly circular in cross-section), or by falling into the work being riveted and causing damage either at that time or later. Consequently it is desirable that broken-off stem portions are disposed of so that they do not constitute such hazards.

Accordingly, the invention provides, in one of its aspects, a breakstem riveting tool comprising:- a riveting head including gripping means for gripping the stem of a rivet and for acting on it thereby to place the rivet and subsequently to break off a portion of the stem projecting from the placed rivet;

a passage leading from the gripping means through the riveting head, through which a broken-off stem portion can pass;

a disposal conduit connected to the other end (i.e. the end remote from the gripping means) of the passage for disposing of a broken-off stem portion which has passed through the passage;

and means for including a first stream of air along the disposal conduit in a direction away from its junction with the passage to assist in disposal of a broken-off stem portion thereby, and for inducing a second stream of air along the passage in a direction from the said other end thereof towards the gripping means.

The means for inducing the air streams may comprise an air injector device positioned at the junction of the passage and the disposal conduit and arranged to inject an airflow into the latter in a direction away from the junction, the arrangement being such that the resistance to airflow therethrough provided by the disposal conduit causes the aforesaid second stream of air along the passage in the direction towards the gripping means, at least when the magnitude of the injected airflow is sufficiently great.

The air injector device may comprise a connecting device which connects the disposal conduit to the passage, the connecting device being provided with at least one air-injecting port arranged at an acute angle to the axis of the conduit. In one embodiment of the invention, the port is provided in the form of a tapering or part-conical annular slot leading into the interior of the connecting device, thereby to inject air around substantially the whole periphery thereof.

Preferably the riveting head is provided with rivet retaining means for retaining a rivet to the place by the tool with its stem in position to be acted on by the gripping means. This may be helpful if the airflow through the passage tends to eject the rivet from the gripping means before the latter act on the stem.

A specific embodiment of the invention will now be described by way of example and with reference to the accompanying drawings, in which:-

Figure 2:
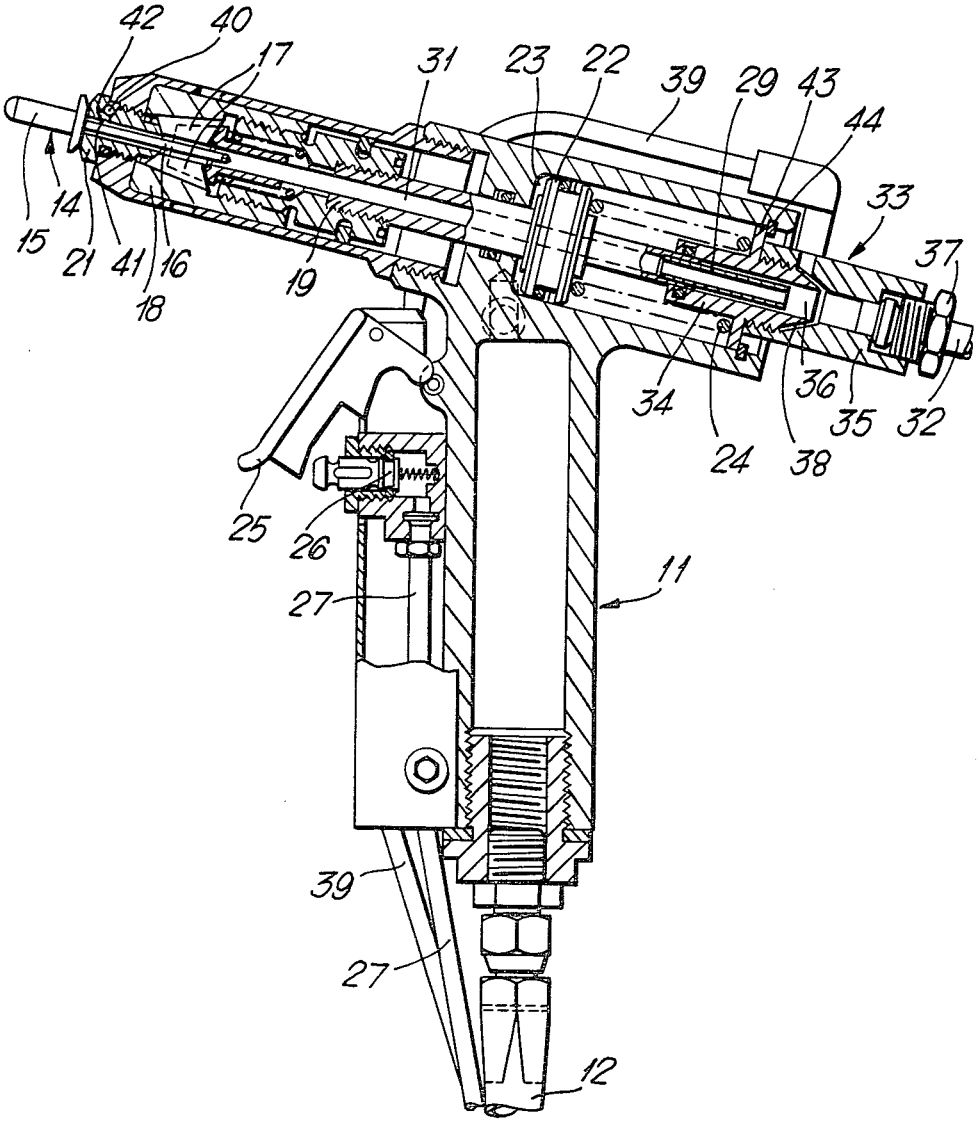

FIG. 1 shows the riveting tool and stem disposal device, and FIG. 2 is a section through the riveting head and air injector device.

The breakstem riveting tool of this example is itself of a well known type, and will be described only in sufficient detail as is necessary for understanding the invention.

The riveting tool of this example is hydro-pneumatically powered and comprises essentially a hydraulically operated riveting head 11 connected by means of a flexible hydraulic hose 12 to a hydro-pneumatic intensifier 13. The riveting tool of this example is intended to place breakstem rivets such as that illustrated at 14 in FIG. 2, for example such as is commercially available under the Registered Trade Mark 'AVEX'. The rivet comprises essentially a deformable metal shell 15 and a stem 16 which is pulled with respect to the shell in order to expand the shell and place the rivet. The stem is provided with a weakened portion or break-neck at which the protruding part of the stem breaks off. The riveting tool includes a stem gripping means in the form of jaws 17 in a collect 18. The collect is secured to a draw bar 19 and when this is retracted the jaws 17 close onto and grip a rivet stem 16 positiond between them, and pull the stem. The rivet shell 15 meanwhile abuts against a nose-tip or anvil 21.

The draw bar 19 is connected to a hydraulic head piston 22 sliding in a head cylinder 23, the space of which on the forward side of the piston 22 is connected to the hydraulic hose 12. A return spring 24 is provided behind the head piston 22. The riveting head 11 carries a trigger 25 which actuates a trigger valve 26 which is connected by means of a signal airline 27 to the hydro-pneumatic intensifier 13. Compressed air at line pressure is supplied to the intensifier 13 through an inlet connection 28. When the trigger 25 is depressed by the operator of the tool, the trigger valve 26 alters the air pressure in the signal airline 27 which actuates the intensifier 13 to admit compressed air to the intensifier pneumatic cylinder. This causes hydraulic pressure (substantially greater than the pneumatic airline pressure) to be applied through the hydraulic hose 12 to the riveting head cylinder 23. This forces the piston 22 rearwardly, overcoming the spring 24, thus retracting the collet 18 to pull the rivet stem and place the rivet as previously described.

The portion of the rivet stem gripped by the jaws 17 breaks off after placing of the rivet, and this broken-off stem remains within the collet 18 after the jaws have returned to their forwards position and opened on release of the trigger 25 with consequent removal of the hydraulic pressure and return of the piston 22 under the urging of the spring 24. The rivet tool head is provided with a continuous passage 31 leading from just behind the jaws to the rear of the head, provided by a tube 29 passing through the draw bar 19 and head piston 22. The broken-off stem of one rivet is pushed along this passage by the insertion into the anvil and the jaws of the next rivet, and this process is repeated with successive rivets so that each broken-off stem portion is eventually pushed through the passage to the rear of the head 11. Allowing the broken-off stem to drop out of the riveting head can be dangerous, as previously explained.

The riveting tool of this example is therefore provided with a stem disposal device. This disposal device consists essentially of a disposal conduit provided by a flexible hose 32 connected to the rear end of the passage 31, and means for causing an airflow along the hose 32 in the form of an air injector device 33. In this example, the remote end of the stem collector hose 32 leads into a stem collecting container or canister 34, which in this particular example is conveniently mounted on the hydro-pneumatic intensifier 13.

The air injector device 33 is shown in more detail in FIG. 2. It is mounted on the rear of the tool head 11, and connects one end of the stem disposal hose 32 to the rear end of the stem ejector passage 31. In this particular example it comprises a forwards part 34 and rearwards part 35, the rear part of the forwards part 34 being screwed into the forwards part of the rear part 35. A bore 36 extends throughout the whole length of the air injector device. This bore receives the rear end of the stem ejector passage tube 29 which reciprocates therein during operation of the tool. The tear part of the bore 36 is connected to the stem disposal hose 32 by means of a coupling 37. The injector device 33 is mounted on the rear end of the tool head 11 by means of a flange 43 on the forwards part 34 which fits into the rear of the bore of the head cylinder 23. The rear end of the head return spring 24 abuts the flange 43 and holds it against a circlip 44 in the rear of the bore. As illustrated in FIG. 2, the rear end of the forwards part 34 and the front end of the rearwards part 35 are both tapered frusto-conically, and they are assembled together with a space between these tapered faces which provides a tapered or frusto-conical port 38 leading rearwardly into the bore 36 at an acute angle. Port 38 is connected to one end of an injector air supply hose 39, the other end of which is supplied with compressed air at line pressure from the air inlet 28 on the pneumatic hydraulic intensifier 13. As long as compressed air is supplied to the inlet 28, a stream of air is injected continuously into the air injector 33 around the whole of its periphery and thus into the stem disposal hose 32 in the direction away from the tool head 11, which blows any broken-off stem entering the hose along the hose towards the collecting container 34.

The resistance to airflow along the stem disposal hose 32 is such that not all of the airflow injected through the port 38 can escape down the hose. Thus there is also created a second airflow, of much smaller magnitude than the airflow along the hose 32, forwardly along the stem ejector passage 31 towards and through the gripping jaws 17. This forwards airflow may be sufficient to tend to eject a rivet 14 inserted in the nose-tip 21. Consequently, in this particular embodiment, there is provided rivet retaining means. This is provied by a peg 41 riding in an inclined transverse bore 42 in the nose-tip. The peg is urged inwardly by means of a circular spring 40 (which may be a greater spring or a resilient ring such as a o-ring seal) so that it frictionally engages the stem 16 of each rivet inserted in the nose-tip.

The invention is restricted to the details of the foregoing example. For instance, the invention may be applied to a breakstem riveting tool in which the rivet stem is rotated rather than pulled in order to place the rivet, for example that which is commercially available under the Registered Trade Mark 'JO-BOLT'.

We claim:

1. A breakstem riveting tool comprising:

a riveting head including gripping means for gripping the stem of a rivet and for acting on it thereby to place the rivet and subsequently to break off a portion of the stem projecting from the placed rivet;

a passage leading from the gripping means through the riveting head, through which a broken-off stem portion can pass;

a disposal conduit connected to the other end of the passage remote from the gripping means for disposing of a broken-off stem portion which has passed through the passage;

and means for inducing a first stream of air along the disposal conduit in a direction away from its junction with the passage to assist in disposal of a broken-off stem portion thereby, and for inducing a second stream of air along the passage in a direction from the said other end thereof towards the gripping means.

2. A riveting tool as claimed in claim 1, in which the means for inducing the air streams comprises an air injector device positioned at the junction of the passage and the disposal conduit and arranged to inject an airflow into the latter in a direction away from the junction, the arrangement being such that the resistance to airflow therethrough provided by the disposal conduit causes the aforesaid second stream of air along the passage in a direction towards the gripping means, at least when the magnitude of the injected airflow is sufficiently great.

3. A riveting tool as claimed in claim 2, in which the air injector device comprises a connecting device which connects the disposal conduit to the passage, the connecting device being provided with at least one air-injecting port arranged at an acute angle to the axis of the conduit.

4. A riveting tool as claimed in claim 3, in which the port is provided in the form of a tapering or part-conical annular slot leading into the interior of the connecting device, thereby to inject air around substantially the whole periphery thereof.

5. A riveting tool as claimed in any one of the preceding claims, in which the riveting head is provided with rivet retaining means for retaining a rivet to the place by the tool with its stem in position to be acted on by the gripping means.

* * * * *

UNITED STATES PATENT AND TRADEMARK OFFICE

CERTIFICATE OF CORRECTION

PATENT NO. : 4,275,582

DATED : June 30, 1981

INVENTOR(S) : David J. Sheffield et al.

It is certified that error appears in the above—identified patent and that said Letters Patent is hereby corrected as shown below:

On the cover sheet Insert (73)--Assignee:

Aerpat A.G., Zug., Switzerland --.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*